US007195676B2

(12) United States Patent
McDermott et al.

(10) Patent No.: US 7,195,676 B2
(45) Date of Patent: Mar. 27, 2007

(54) METHOD FOR REMOVAL OF FLUX AND OTHER RESIDUE IN DENSE FLUID SYSTEMS

(75) Inventors: Wayne Thomas McDermott, Fogelsville, PA (US); Gene Everad Parris, Coopersburg, PA (US); Dean Van-John Roth, Center Valley, PA (US); Hoshang Subawalla, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/890,502

(22) Filed: Jul. 13, 2004

(65) Prior Publication Data

US 2006/0011217 A1 Jan. 19, 2006

(51) Int. Cl.
*C23G 1/00* (2006.01)

(52) U.S. Cl. ..... 134/2; 134/20; 134/26; 134/30; 134/34; 134/35; 134/36; 134/42; 134/902

(58) Field of Classification Search ..... 134/2, 134/26, 30, 34, 35, 36, 42, 902, 20
See application file for complete search history.

(56) References Cited

U.S. PATENT DOCUMENTS 4,944,837 A 7/1990 Nishikawa et al.
4,992,308 A 2/1991 Sunol
5,013,366 A * 5/1991 Jackson et al. ..... 134/1
5,158,704 A 10/1992 Fulton et al.
5,236,602 A 8/1993 Jackson
5,266,205 A 11/1993 Fulton et al.
5,355,901 A 10/1994 Mielnik et al.
5,370,740 A 12/1994 Chao et al.
5,377,705 A 1/1995 Smith, Jr. et al.
5,417,768 A 5/1995 Smith, Jr. et al.
5,494,526 A 2/1996 Paranjpe
5,522,938 A 6/1996 O'Brien (Continued)

FOREIGN PATENT DOCUMENTS

EP 0 836 895 A2 4/1998

(Continued)

OTHER PUBLICATIONS

M. Todd, et al., "Effects of Post-Reflow Cleaning Processes on the Performance of Flip Chip Devices," Dexter Corporation Technical Paper, Mar. 2000.

(Continued)

*Primary Examiner*—Sharidan Carrillo
(74) *Attorney, Agent, or Firm*—Rosaleen P. Morris-Oskanian; Joseph D. Rossi

(57) ABSTRACT

Method for removing flux residue and defluxing residue from an article using a dense processing fluid and a dense rinse fluid is disclosed herein. In one embodiment, there is provided a method comprising: introducing the article comprising contaminants into a processing chamber; contacting the article with a dense processing fluid comprising a dense fluid, at least one processing agent, and optionally a cosolvent to provide a partially treated article; and contacting the partially treated article with a dense rinse fluid comprising the dense fluid and optionally the cosolvent to provide a treated article wherein an agitation source is introducing during at least a portion of the first and/or the second contacting step.

8 Claims, 5 Drawing Sheets

U.S. PATENT DOCUMENTS

| | | | | |
|---|---|---|---|---|
| 5,533,538 | A | 7/1996 | Marshall | |
| 5,733,964 | A | 3/1998 | Johnston et al. | |
| 5,783,082 | A | 7/1998 | DeSimone et al. | |
| 5,789,505 | A | 8/1998 | Wilkinson et al. | |
| 5,866,004 | A | 2/1999 | Houck et al. | |
| 5,866,005 | A | 2/1999 | DeSimone et al. | |
| 5,868,856 | A | 2/1999 | Douglas et al. | |
| 5,872,257 | A | 2/1999 | Beckman et al. | |
| 5,873,948 | A | 2/1999 | Kim | |
| 5,908,510 | A | 6/1999 | McCullough et al. | |
| 5,944,996 | A | 8/1999 | DeSimone et al. | |
| 5,976,264 | A | 11/1999 | McCullough et al. | |
| 6,024,801 | A | 2/2000 | Wallace et al. | |
| 6,113,708 | A | 9/2000 | Hopple et al. | |
| 6,176,895 | B1 | 1/2001 | DeSimone et al. | |
| 6,224,774 | B1 | 5/2001 | DeSimone et al. | |
| 6,228,563 | B1 | 5/2001 | Starov et al. | |
| 6,240,936 | B1 | 6/2001 | DeSimone et al. | |
| 6,242,165 | B1 | 6/2001 | Vaartstra | |
| 6,270,531 | B1 | 8/2001 | DeYoung et al. | |
| 6,277,753 | B1 | 8/2001 | Mullee et al. | |
| 6,286,231 | B1 | 9/2001 | Bergman et al. | |
| 6,297,206 | B2 | 10/2001 | Romack et al. | |
| 6,306,564 | B1 | 10/2001 | Mullee | |
| 6,331,487 | B2 | 12/2001 | Koch | |
| 6,333,268 | B1 | 12/2001 | Starov et al. | |
| 6,344,243 | B1 | 2/2002 | McClain et al. | |
| 6,357,142 | B1 | 3/2002 | Bergman et al. | |
| 6,403,544 | B1 | 6/2002 | Davenhall et al. | |
| 6,454,869 | B1 | 9/2002 | Cotte et al. | |
| 6,500,605 | B1 | 12/2002 | Mullee et al. | |
| 6,506,259 | B1 | 1/2003 | Romack et al. | |
| 6,589,355 | B1 | 7/2003 | Thomas et al. | |
| 6,688,115 | B1 * | 2/2004 | Gershtein | 62/54.1 |
| 7,044,143 | B2 * | 5/2006 | DeYoung et al. | 134/105 |
| 2002/0026729 | A1 | 3/2002 | Bergman et al. | |
| 2002/0055323 | A1 | 5/2002 | McClain et al. | |
| 2002/0088477 | A1 | 7/2002 | Cotte et al. | |
| 2002/0112747 | A1 | 8/2002 | DeYoung et al. | |
| 2002/0164873 | A1 | 11/2002 | Masuda et al. | |
| 2003/0003762 | A1 | 1/2003 | Cotte et al. | |
| 2003/0106573 | A1 | 6/2003 | Masuda et al. | |
| 2003/0217764 | A1 * | 11/2003 | Masuda et al. | 134/26 |
| 2004/0050406 | A1 * | 3/2004 | Sehgal | 134/26 |
| 2004/0055621 | A1 * | 3/2004 | McDermott et al. | 134/1.3 |
| 2004/0055624 | A1 * | 3/2004 | McDermott et al. | 134/26 |
| 2004/0087456 | A1 * | 5/2004 | Korzenski et al. | 510/175 |
| 2004/0103922 | A1 * | 6/2004 | Inoue et al. | 134/26 |
| 2004/0144399 | A1 * | 7/2004 | McDermott et al. | 134/1 |
| 2004/0154333 | A1 | 8/2004 | Gershtein et al. | |
| 2004/0198627 | A1 | 10/2004 | Masuda et al. | |
| 2004/0224865 | A1 * | 11/2004 | Roeder et al. | 510/175 |
| 2005/0029490 | A1 | 2/2005 | Subawalla et al. | |
| 2005/0029492 | A1 | 2/2005 | Subawalla et al. | |

FOREIGN PATENT DOCUMENTS

| | | |
|---|---|---|
| WO | WO 84/02291 | 6/1984 |
| WO | WO 99/49996 | 10/1999 |
| WO | WO 99/49998 | 10/1999 |
| WO | WO 99/61177 | 12/1999 |
| WO | WO 00/16264 | 3/2000 |
| WO | WO 00/26421 | 5/2000 |
| WO | WO 01/21616 | 3/2001 |
| WO | WO 01/32323 A1 | 5/2001 |
| WO | WO 01/33613 A2 | 5/2001 |
| WO | WO 01/60534 A1 | 8/2001 |
| WO | WO 01/87505 | 11/2001 |
| WO | WO 02/11191 | 2/2002 |
| WO | WO 02/15251 A1 | 2/2002 |
| WO | WO 02/66176 | 8/2002 |
| WO | WO 2005/038898 A1 | 4/2005 |

OTHER PUBLICATIONS

J. McHardy, et al., Supercritical Fluid Cleaning: Fundamentals, Technology and Applications, Noyes Publications, Westwood, New Jersey, 1998.

B. Kanegsberg, et al., "Handbook for Critical Cleaning," CRC Press, New York, NY, 2001.

K. Jackson, et al., "Microemulsions in Supercritical Hydrochlorofluorocarbons," Langmuir 12(22), pp. 5289-5295 (1996).

M. A. Biberger, et al., "Photoresist and Photoresist Residue Removal with Supercritical $CO_2$—A Novel Approach to Cleaning Wafers," Semiconductor Fabtech, 12th Ed., pp. 239-243.

D. Beery, et al., "Post Etch Residue Removal: Novel Dry Clean Technology Using Densified Fluid Cleaning (DFC)," IITC 99, pp. 140-142.

J. Liu, et al., "Investigation of Nonionic Surfactant Dynol-604 Based Reverse Microemulsions Formed in Supercritical Carbon Dioxide," Langmuir 17, pp. 8040-8043 (2001).

K. Jackson, et al., "Surfactants and Microemulsions in Supercritical Fluids," Supercritical Fluid Cleaning, pp. 87-120.

R. A. Bowling, et al., "Future Challenges for Cleaning in Advanced Microelectronics," Texas Instruments slides.

H. J. Martinez, et al., "$SCCO_2$—Is it an Enabling Technology for the 90nm Node and Beyond?" International SeMatech slides (2002).

S. Pawat, "Novel Wafer Clean Technologies," International SeMatech slides (2001).

T. Hurd, et al., "$scCO_2$ Cleaning Applications in Porous ULK Processing," Texas Instruments slides.

G. L. Weibel, et al., "Supercritical $CO_2$ in Microelectronics Processing," Cornell University slides.

J. B. Rubin, et al., "Precision Cleaning of Semiconductor Surfaces Using Carbon Dioxide-Based Fluids," Clarkson University, pp. 1-26.

G. Weibel, "Supercritical $CO_2$ for Semiconductor Applications," Semiconductor Equipment and Materials International (2001).

J. Malloy, et al., "GC Analysis of Solvent Wash Samples," Air Products and Chemicals, Inc. (2003).

Carpenter, B.A. et al., Supercritical Fluid Extraction and Chromatography, *ACS Symposium Series 366*, Apr. 5-10, 1987, Denver, CO.

Devittori, C. et al., Article at http://mpi.powerultrasonics.com/cleaning-co2,html, "Multifrequency ultrasonic Actuators with Special Application to Ultrasonic Cleaning in Liquid and Supercritical CO2".

Enokida, Y. et al., "Ultrasound-Enhanced Dissolution of UO2 in Supercritical CO2 Containing a CO2-Philic Complexant of Tri-n-Butylphosphate and Nitric Acid", *Industrial & Engineering Chemistry Research*, (2002), 41 (9), pp. 2282-2286.

* cited by examiner

METHOD FOR REMOVAL OF FLUX AND OTHER RESIDUE IN DENSE FLUID SYSTEMS

BACKGROUND OF THE INVENTION

Flip chip and wafer level packaging (WLP) technologies have become ubiquitous in recent years in applications from consumer and wireless devices to high-performance electronics. As requirements for high performance and reduced form factor grow, likewise the demands on these packaging technologies grow as well. A variety of high-end processes are employed for flip chip, wafer bumping, and WLP. These processes may include, for example, electroplating of metals, solder paste deposition, and dielectric formation using materials such as fluxes that need to be completely removed during the manufacturing process. Failure to completely remove these materials can result in contamination, yield loss, downstream problems in test and board level assembly, and reliability fallout in the field.

In the manufacture of electronic devices, solder is commonly applied to at least a portion of the solderable surface on articles such as, for example, integrated circuits (IC), surface-mount assemblies, flip chip assemblies, and the like, to provide a solder joint. For example, in the assembly of a flip chip assembly, one substrate having a plurality of solder bumps is attached face down onto another substrate. This attachment method may eliminate the need for first level IC packaging and provides a solution for system designs that are constrained by size, input/output ("I/O") density, electrical performance (e.g., signal speed), reliability, or cost. Wafer bumping, or the reflow of solder into uniform ellipsoidal bumps, may be performed following the deposition of under-bump-metallurgy (UBM) and the deposition of the solder. Typical UBM consists of electroless nickel plated onto exposed aluminum, which is then followed by a protective layer of gold to prevent pad oxidation. Solder can then be deposited onto the plated pads using conventional photolithographic/vapor deposition techniques. More recently, solder paste has been deposited using stencil printing techniques with application tools such as squeegees or pressurized heads such as in an extrusion process.

The presence of an oxide on the solder surface can interfere with the reflow process. Consequently, surface oxides should be removed prior to reflow. The most common method for wafer bumping involves the use of an organic flux to reduce surface oxides. After flux is applied to reduce the surface oxides, subsequent packaging steps required to assemble flip chip devices include, for example, aligning the flip chip with substrate; reflowing solder under elevated temperature to create a bond; solvent cleaning to remove the flux (also referred to herein as "de-fluxing"); rinsing to remove residual solvent from cleaning; and under filling the flip chip.

Light emitting diode (LED) assemblies are packaged using similar wafer bumping and mounting methods as described above. After reflow soldering to bond the LED to the substrate, the substrate is cut into smaller sized components and mounted on the lead frame assembly using a solder paste that may have a flux contained therein. The de-fluxing step is typically performed using liquid or vapor phase solvents. Liquid phase de-fluxing may be performed, for example, using ultrasonic baths.

The solder joint in the flip chip assembly may be susceptible to defects such as crack growth and interfacial delamination. These defects can be attributed to stresses resulting from mechanical vibration and/or variation in ambient temperature leading to differential thermal expansion of the assembly. To remedy this, under fill materials, which are typically epoxy-based materials, are used to fill the gap between the flip chip and substrate around the solder joints thereby reducing stresses on the solder joint. In addition to reducing stresses on the assembly, under fill materials may also prevent corrosion of the solder joint through a sealing process. High adhesion of the under fill material to the substrate and die may be necessary to ensure reliability of the interconnect system.

Organic flux residues and/or solvent residues present on the surfaces of flip chip assemblies after wafer bumping or reflow soldering can affect the properties of the under fill material. The reliability of flip chip packages may be substantially reduced by flux/under fill incompatibility and/or by solvent/under fill incompatibility. Inadequate cleaning techniques can lead to inconsistent under fill flow patterns, void generation, and poor interfacial bond strengths. Typical failure modes include voids, filler striations, under fill delamination, under fill cracking, mechanical fatigue and corrosion. Corrosion-related failures can occur, for example, in the solder interconnect or in the substrate metallization. High temperatures, high humidity and reactive species (e.g., from the under fill or flux residues) can accelerate corrosion-related failures. Factors leading to poor performance of under fill materials include, but are not limited to, flux residues interfering with under fill flow and/or chemically reacting with the under fill; solvent residues from the cleaning steps interfering with under fill flow; and difficulties encountered with conventional methods of applying cleaning solvents in certain assemblies (e.g., assemblies having increasingly tight pitches or pitches of 200 microns ("μm") or less, low standoffs or standoffs of 50 μm or less, and dense arrays of solder bumps).

Conventional wet processing methods may be inadequate to meet industry needs as technologies advance and as environmental restrictions increase. Among the limitations of conventional wet processing methods are the high cost and purity requirements of cleaning agents, progressive contamination of re-circulated liquids, re-deposition from contaminated chemicals, special disposal requirements, environmental damage, special safety procedures during handling, dependence of cleaning effectiveness on surface wet-ability to prevent re-adhesion of contaminants, and possible liquid residue causing adhesion of remaining contaminants. In addition, the International Technology Roadmap for Semiconductors has recommended a significant reduction in the use of water in various processing steps to prevent water shortages. Moreover, with the continuing trend toward increasing wafer diameters having a larger precision surface area, a larger volume of wet processing chemicals may be required to complete the fabrication process. Therefore, there is an increasing need to replace environmentally damaging fluxing and de-fluxing processes with more environmentally friendly processes and chemistries.

The above problems have driven the electronics industry to pursue fluxless surface reduction methods for wafer bumping and flip chip assembly. Such methods include surface reduction in reducing atmospheres (e.g., $H_2$), laser ablation of oxides, and plasma techniques. However, the aforementioned processes present inherent economic and technical challenges. For example, some applications of hydrogen fluxless soldering may require high concentrations of flammable gas. Also, the melting or boiling points of oxide and base metal can be similar. It is not desirable to melt or boil the base metal during de-oxidation. Therefore, laser ablation processes are difficult to implement. Plasma techniques require expensive vacuum and electrical equipment, and create potentially damaging space charge and electromagnetic waves.

BRIEF SUMMARY OF THE INVENTION

A method for the removal of contaminants, including flux residue and defluxing residue, from an article, along with a dense processing fluid and a dense rinse fluid for performing same, is disclosed herein. In one aspect, there is provided a method for removing contaminants from an article comprising: introducing the article comprising contaminants into a processing chamber; contacting the article with a dense processing fluid comprising a dense fluid, at least one processing agent, and optionally a cosolvent to provide a partially treated article; and contacting the partially treated article with a dense rinse fluid comprising the dense fluid and optionally the cosolvent to provide a treated article.

In another aspect there is provided a method for processing an article comprising contaminants comprising: introducing the article into a processing chamber and sealing the processing chamber; preparing a dense fluid by: introducing a subcritical fluid into a pressurization vessel and isolating the vessel; and heating the subcritical fluid at essentially constant volume and essentially constant density to yield a dense fluid; transferring at least a portion of the dense fluid from the pressurization vessel to the processing chamber, wherein the transfer of the dense processing fluid is driven by the difference between the pressure in the pressurization vessel and the pressure in the processing chamber, thereby pressurizing the processing chamber with transferred dense fluid; introducing one or more processing agents and optionally one or more cosolvents into the processing chamber either before, during, and/or after the transferring step to provide a dense processing fluid; contacting the article with the dense processing fluid to provide a spent dense processing fluid and a partially treated article; introducing optionally one or more cosolvents into the processing chamber either before, during, or after the transferring step to provide a dense rinse fluid; and contacting the partially treated article with the dense rinse fluid to provide a spent dense rinse fluid and a treated article that is substantially free of contaminants.

In yet another aspect of the invention, there is provided method for removing contaminants from an article comprising: introducing the article comprising contaminants into a processing chamber; contacting the article with a dense processing fluid comprising a dense fluid, at least one processing agent, and optionally a cosolvent to provide a partially treated article; and contacting the partially treated article with a dense rinse fluid comprising the dense fluid and optionally the cosolvent to provide a treated article wherein an agitation source is introducing during at least a portion of the first and/or the second contacting step.

DETAILED DESCRIPTION OF THE INVENTION

Figure 1:
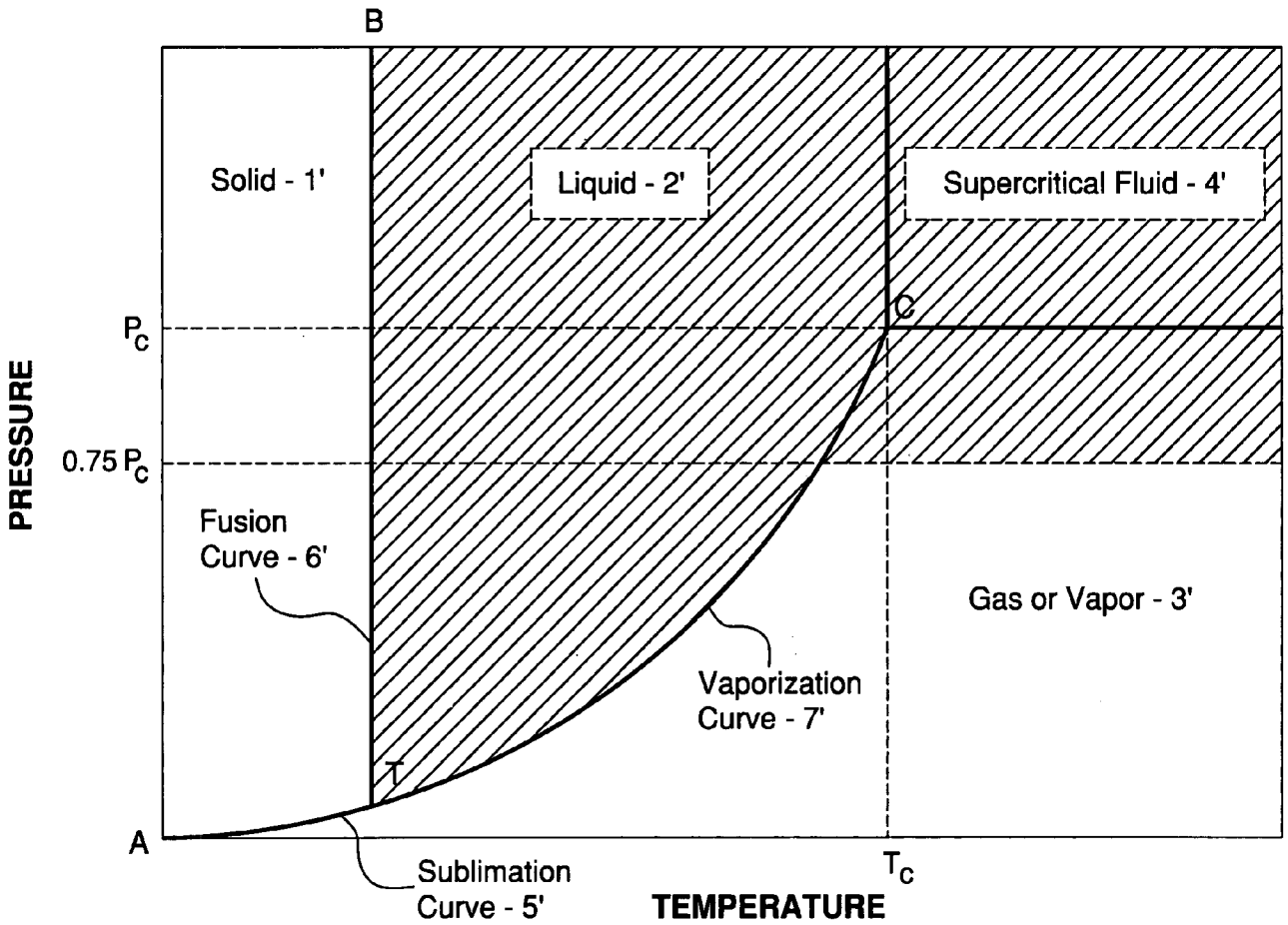
Figure 1 (Prior Art)
FIG. 1 is a pressure-temperature phase diagram for a single component supercritical fluid.

A method for the removal of contaminants, including flux residue and defluxing residue, from an article, along with a dense processing fluid and a dense rinse fluid for performing same, is disclosed herein. Since many of the components of the dense processing fluid and the dense rinse fluid, such as, for example, carbon dioxide and/or the fluorinated fluids described herein, are gases at standard temperatures and pressures, the method of contacting articles with the dense processing fluid and the dense rinse fluid may be considered dry. As a result, substantially little to no moisture remains on the article after exposure to these dense fluids. The dense processing fluid and dense rinse fluid are used to remove contaminants generated from the flux application step and the flux removal or defluxing step. Flux residues may leave behind ionic (flux activators, plating salt residue, salts from handling) and non-ionic (rosin, resin, oils) contaminants. In certain embodiments, the processing fluid has an affinity for both types of contaminants. Also disclosed herein is a rinse fluid for removing contaminants generated from the flux removal step such as for example, films, particles, and other processing residue, on the surface of the article.

The term "processing" or "processed" as used herein means contacting an article with a dense processing fluid to effect physical and/or chemical changes to the article. The term "article" as used herein means any article of manufacture that can be contacted with a dense processing fluid or a dense rinse fluid wherein at least a portion of the surface has had flux applied thereto and/or flux removed therefrom. Such articles may include, for example, silicon wafers or wafers made from compound semiconductor materials such as gallium arsenide, indium phosphide, silicon-germanium and the like, printed circuit boards, surface mounted assemblies, flip chip assemblies, electronic assemblies, and other related articles subject to contamination during fabrication.

Dense fluids are suitable for conveying processing agents to articles such as microelectronic components undergoing processing steps and for removing undesirable components from the microelectronic components upon completion of the process steps. These process steps typically are carried out batch wise and may include, for example, cleaning, extraction, film stripping, etching, deposition, drying, photoresist development, and planarization. Other uses for dense fluids include precipitation of nano-particles and suspension of metallic nano-crystals.

Dense fluids are an ideal medium for these applications because these fluids exhibit one or more of the following: high solvent power, low viscosity, high diffusivity, and negligible surface tension relative to the articles being processed. In certain embodiments, the processing fluids used in microelectronic processing should have extremely high purity, or purity that is higher than that of similar fluids used in other applications. The generation of extremely high purity dense fluids for these applications should be performed with great care, preferably using the methods described herein. The dense processing fluid and the dense rinse fluid described herein can effectively dissolve and remove unwanted films and molecular contaminants from a precision surface. For example, in one embodiment, after removal of the flux residue, the contaminants can then be separated from the processing agent by a reduction in pressure below a pressure at which the contaminant becomes insoluble in the dense processing fluid. This procedure may concentrate the contaminants for disposal and allow for the recovery and re-use of the cleaning fluid.

In certain embodiments, the dense processing fluid may be used in a cleaning process such as in a defluxing process. Typical contaminants to be removed from these articles in a cleaning process may include, for example, organic compounds such as organic fluxes; water soluble flux residues; insoluble salts and other inorganic residues; reactive halides from under fill and flux residues; metal containing compounds such as organometallic residues and metal organic compounds; ionic flux activators; plating salt residues; non-ionic rosin resin oils, ionic and neutral, light and heavy inorganic (metal) species, moisture, and insoluble materials, including particles generated by the flux removal step; cleaning or processing residue such as films, particles, moisture and the like generated from the defluxing and/or cleaning and other processing step(s).

FIG. 1 is a pressure-temperature phase diagram for a single component supercritical fluid. The term "component" as used herein means an element (for example, hydrogen, helium, oxygen, nitrogen) or a compound (for example, carbon dioxide, methane, nitrous oxide, propane). Referring to FIG. 1, four distinct regions or phases, solid 1', liquid 2', gas 3' and supercritical fluid 4', exist for a single component. The critical point, designated "C" in FIG. 1, is defined as that pressure (critical pressure $P_c$) and temperature (critical temperature $T_c$) below which a single component can exist in vapor/liquid equilibrium. The density of the single component at the critical point is its critical density. Also shown in FIG. 1 are the sublimation curve 5', or the line between "A" and "T" which separates the solid 1' and gas 3' regions, the fusion curve 6', or the line between "T" and "B" which separates the liquid 2' and solid 1' regions, and the vaporization curve 7', or the line between "T" and "C" which separates the liquid 2' and gas 3' regions. The three curves meet at the triple point, designated "T", wherein the three phases, or solid, liquid and gas, coexist in equilibrium. A phase is generally considered a liquid if it can be vaporized by reducing pressure at constant temperature. Similarly, a phase is considered a gas if it can be condensed by reducing the temperature at a constant pressure. The gas and liquid regions become indistinguishable at or above the critical point C, as shown in FIG. 1.

A single-component supercritical fluid is defined as a fluid at or above its critical temperature and pressure. A related single-component fluid having similar properties to the single-component supercritical fluid is a single-phase fluid, which exists at a temperature below its critical temperature and a pressure above its liquid saturation pressure. An additional example of a single-component dense fluid may be a single-phase fluid at a pressure above its critical pressure or a pressure above its liquid saturation pressure. A single-component subcritical fluid is defined as a fluid at a temperature below its critical temperature or a pressure below its critical pressure or alternatively a pressure P in the range $0.75P_c \leqq P \leqq P_c$ and a temperature above its vapor saturation temperature. In the present disclosure, the term "dense fluid" as applied to a single-component fluid is defined to include a supercritical fluid, a single-phase fluid which exists at a temperature below its critical temperature and a pressure above its liquid saturation pressure, a single-phase fluid at a pressure above its critical pressure or a pressure above its liquid saturation pressure, and a single-component subcritical fluid. An example of a single component dense fluid is shown as the thatched region in FIG. 1.

A dense fluid alternatively may comprise a mixture of two or more components. A multi-component dense fluid differs from a single-component dense fluid in that the liquid saturation pressure, critical pressure, and critical temperature are functions of composition. In this case, the dense fluid is defined as a single-phase multi-component fluid of a given composition which is above its saturation or bubble point pressure, or which has a combination of pressure and temperature above the mixture critical point. The critical point for a multi-component fluid is defined as the combination of pressure and temperature above which the fluid of a given composition exists only as a single phase. In the present disclosure, the term "dense fluid" as applied to a multi-component fluid is defined to include both a supercritical fluid and a single-phase fluid that exists at a temperature below its critical temperature and a pressure above its bubble point or saturation pressure. A multi-component dense fluid also can be defined as a single-phase multi-component fluid at a pressure above its critical pressure or a pressure above its bubble point or liquid saturation pressure. A multi-component dense fluid can also be defined as a single-phase or multi-phase multi-component fluid at a pressure P in the range $0.75P_c \leqq P \leqq P_c$, and a temperature above its bubble point or liquid saturation temperature. A multi-component subcritical fluid is defined as a multi-component fluid of a given composition, which has a combination of pressure and temperature below the mixture critical point.

The generic definition of a dense fluid thus includes a single component dense fluid as defined above as well as a multi-component dense fluid as defined above. Similarly, a subcritical fluid may be a single-component fluid or a multi-component fluid. In some embodiments, a single-component subcritical fluid or a multi-component subcritical fluid may be a dense fluid.

Figure 2:
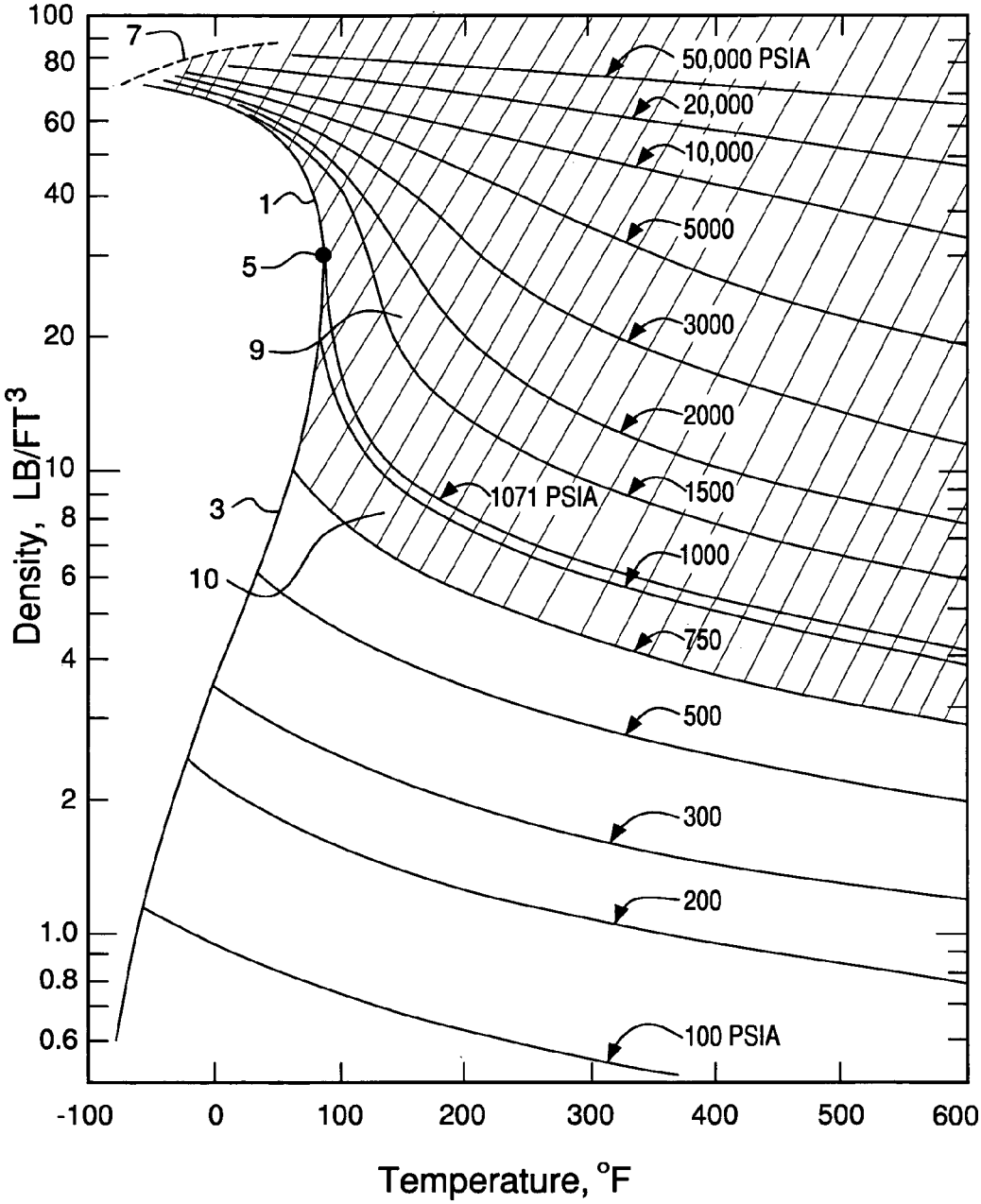
Figure 2 (Prior Art)
FIG. 2 is a density-temperature phase diagram for carbon dioxide.

An example of a dense fluid for a single component is illustrated in FIG. 2, which is a representative density-temperature phase diagram for carbon dioxide. This diagram shows saturated liquid curve 1 and saturated vapor curve 3, which merge at critical point 5 at the critical temperature of 87.9° F. and critical pressure of 1,071 psia. Lines of constant pressure (isobars) are shown, including the critical isobar of 1,071 psia. Line 7 is the melting curve. The region to the left of and enclosed by saturated liquid curve 1 and saturated vapor curve 3 is a two-phase vapor-liquid region. The region outside and to the right of liquid curve 1, saturated vapor curve 3, and melting curve 7 is a single-phase fluid region. The dense fluid as defined herein is indicated by cross-hatched regions 9 (at or above critical pressure) and 10 (below critical pressure).

Figure 3:
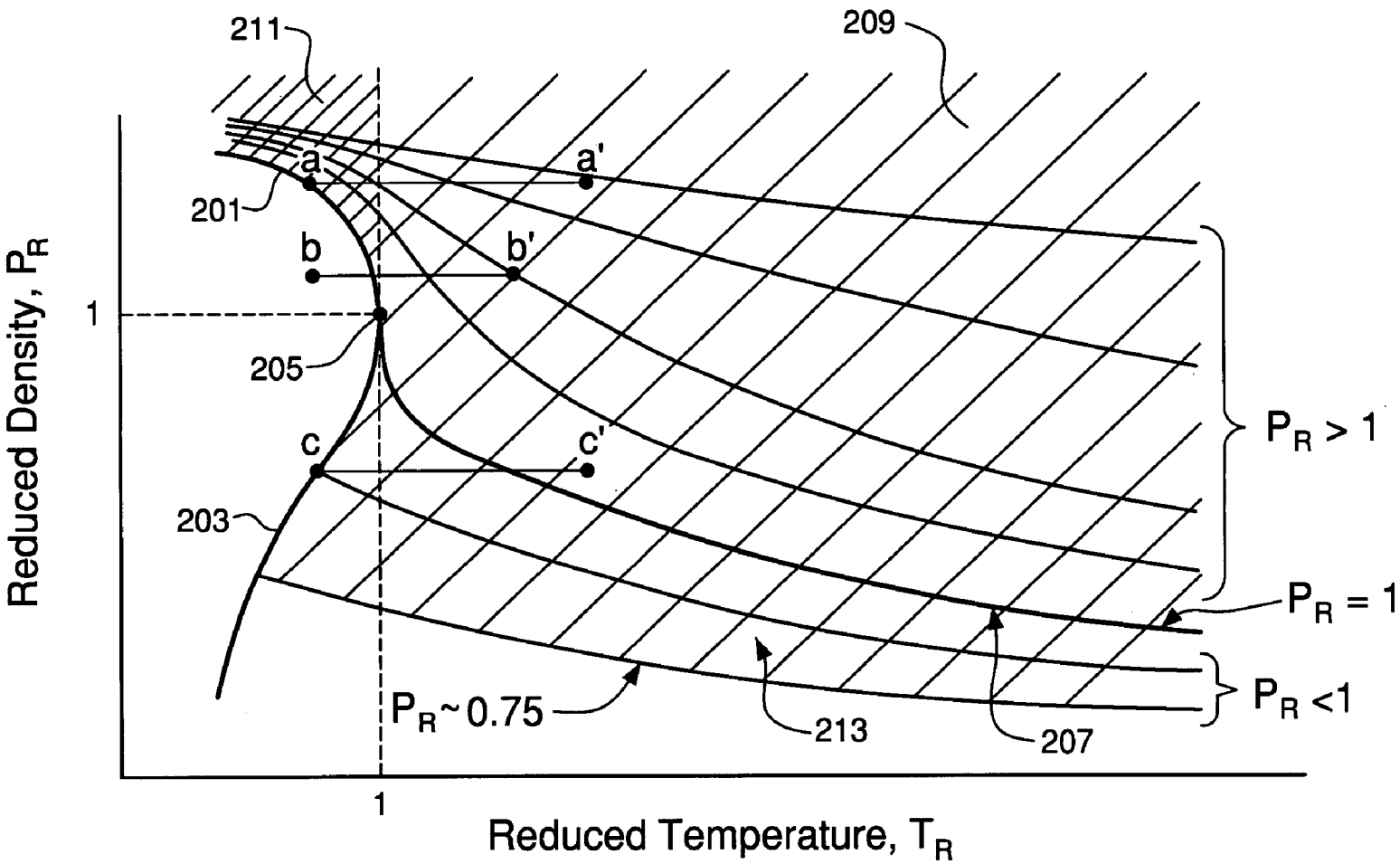
Figure 3 (Prior Art)
FIG. 3 is a generalized density-temperature phase diagram.

A generic density-temperature diagram can be defined in terms of reduced temperature, reduced pressure, and reduced density as shown in FIG. 3. The reduced temperature ($T_R$) is defined as the absolute temperature divided by the absolute critical temperature, reduced pressure ($P_R$) is defined as the absolute pressure divided by the absolute critical pressure, and reduced density ($\rho_R$) is defined as the density divided by the critical density. The reduced temperature, reduced pressure, and reduced density are all equal to 1 at the critical point by definition. FIG. 3 shows analogous features to FIG. 2 including saturated liquid curve 201 and saturated vapor curve 203, which merge at critical point 205 at a reduced temperature of 1, a reduced density of 1, and a reduced pressure of 1. Lines of constant pressure (isobars) are shown, including critical isobar 207 for which $P_R$=1. In FIG. 3, the region to the left of and enclosed by saturated liquid curve 201 and saturated vapor curve 203 is the two-phase vapor-liquid region. The crosshatched region 209 above the $P_R$=1 isobar and to the right of the critical temperature $T_R$=1 is a single-phase supercritical fluid region. The crosshatched region 211 above saturated liquid curve 201 and to the left of the critical temperature $T_R$=1 is a single-phase compressed liquid region. The cross-thatched region 213 to the right of saturated vapor curve 203, and below the isobar $P_R$=1 represents a single-phase compressed or dense gas. The dense fluid as defined herein includes single-phase supercritical fluid region 209, single-phase compressed liquid region 211, and the single-phase dense gas region 213.

The generation of a dense fluid used in certain embodiments may be illustrated using FIG. 3. In one embodiment, a saturated liquid at point a is introduced into a vessel and sealed therein. The sealed vessel is heated isochorically, i.e., at essentially constant volume, and isopycnically, i.e., at essentially constant density. The fluid moves along the line as shown to point a' to form a supercritical fluid in region 209. This is generically a dense fluid as defined above. Alternatively, the fluid at point a may be heated to a temperature below the critical temperature ($T_R$=1) to form a compressed liquid. This also is a generic dense fluid as defined above. In another embodiment, a two-phase vapor liquid mixture at point b is introduced into a vessel and sealed therein. The sealed vessel is heated isochorically, i.e., at essentially constant volume, and isopycnically, i.e., at essentially constant density. The fluid moves along the line as shown to point b' to form a supercritical fluid in region 209. This is generically a dense fluid as defined above. In another embodiment, a saturated vapor at point c is introduced into a vessel and sealed therein. The sealed vessel is heated isochorically, i.e., at essentially constant volume, and isopycnically, i.e., at essentially constant density. The fluid moves along the line as shown to point c' to form a supercritical fluid in region 209. This is generically a dense fluid as defined above. In yet another embodiment an unsaturated vapor at point d is introduced into a vessel and sealed therein. The sealed vessel is heated isochorically, i.e., at essentially constant volume, and isopycnically, i.e., at essentially constant density. The fluid moves along the line as shown to point d' to form a dense gas in region 213. This is generically a dense fluid as defined above.

The final density of the dense fluid is determined by the volume of the vessel and the relative amounts of vapor and liquid originally introduced into the vessel. A wide range of densities thus is achievable by this method. The terms "essentially constant volume" and "essentially constant density" mean that the density and volume are constant except for negligibly small changes to the volume of the vessel that may occur when the vessel is heated.

Depending upon the application, the dense fluid may be either a single-component fluid or a multi-component fluid, and may have a reduced temperature ranging from about 0.2 to about 2.0, and a reduced pressure above 0.75. The reduced temperature is defined here as the absolute temperature of the fluid divided by the absolute critical temperature of the fluid, and the reduced pressure is defined here as the absolute pressure divided by the absolute critical pressure.

In alternative embodiments, the dense fluid is provided by using a compressor, pump, or the like to bring the fluid to its supercritical state. The conditions that are needed to reach supercritical state may vary depending upon the one or more components contained within the dense fluid.

The dense fluid may comprise, but is not limited to, one or more components selected from the group consisting of carbon dioxide, nitrogen, methane, oxygen, ozone, argon, hydrogen, helium, ammonia, nitrous oxide, hydrocarbons having 2 to 6 carbon atoms, hydrogen chloride, sulfur trioxide, and water.

In certain embodiments of the present invention, the dense processing fluid and/or the dense rinse fluid comprises one or more fluorinated fluids, such as, but not limited to, perfluorocarbon compounds (e.g., tetrafluoromethane ($CF_4$) and hexafluoroethane ($C_2F_6$)), hydrofluorocarbons (e.g., difluoromethane ($CH_2F_2$), trifluoromethane ($CHF_3$), methyl fluoride ($CH_3F$), pentafluoroethane ($C_2HF_5$), trifluoroethane ($CF_3CH_3$), difluoroethane ($CHF_2CH_3$), and ethyl fluoride ($C_2H_5F$)), fluorinated nitriles (e.g., perfluoroacetonitrile ($C_2F_3N$) and perfluoropropionitrile ($C_3F_5N$)), fluoroethers (e.g., perfluorodimethylether ($CF_3$—O—$CF_3$), pentafluorodimethyl ether ($CF_3$—O—$CHF_2$), trifluoro-dimethyl ether ($CF_3$—O—$CH_3$), difluoro-dimethyl ether ($CF_2H$—O—$CH_3$), and perfluoromethyl vinyl ether ($CF_2$=CFO—$CF_3$)), fluoroamines (e.g., perfluoromethylamine ($CF_5N$)), and other fluorinated compounds such as nitrogen trifluoride ($NF_3$), carbonyl fluoride ($COF_2$), nitrosyl fluoride (FNO), hexafluoropropylene oxide ($C_3F_6O_2$), hexafluorodisiloxane ($Si_2OF_6$), hexafluoro-1,3-dioxolane ($C_3F_6O_2$), hexafluoropropylene oxide ($C_3F_6O$), fluoroxytrifluoromethane ($CF_4O$), bis(difluoroxy)methane ($CF_4O_2$), difluorodioxirane ($CF_2O_2$), trifluoronitrosylmethane ($CF_3NO$)), hydrogen fluoride, sulfur hexafluoride, chlorine trifluoride, hexafluoropropylene, hexafluorobutadiene, octafluorocyclobutane, tetrafluorochloroethane, and the like.

Further examples of fluorinated dense fluids include, but are not limited to, zeotropic and azeotropic mixtures of different refrigerants such as 507A (mixture of pentafluoroethane and trifluoroethane) and 410A (mixture of difluoromethane and pentafluoroethane). These fluorinated fluids are used either independently or in mixtures.

The one or more of the above fluorinated fluids may be added to the dense processing fluid and/or the dense rinse fluid in a liquid, gaseous, or supercritical state. In embodiments wherein the fluorinated fluid is used in its supercritical state, fluorinated fluids with a low critical temperature ($T_c$) and critical pressure ($P_c$) may be preferable. The normal boiling point temperatures ($T_b$), critical temperatures and critical pressures of some exemplary fluorinated dense fluids are provided in Table I.

TABLE I

Thermodynamic Properties of Select Fluorinated Solvents

| Solvent/Gas | Formula | $T_b$ (° C.) | $T_c$ (° C.) | $P_c$ (bar) |
|---|---|---|---|---|
| Nitrogen trifluoride | $NF_3$ | −129.1 | −39.0 | 45.3 |
| Tetrafluoromethane | $CF_4$ | −127.9 | −45.4 | 37.4 |
| Trifluoromethane | $CHF_3$ | −82.1 | 26.3 | 48.6 |
| Hexafluoroethane | $C_2F_6$ | −78.2 | 20.0 | 30.6 |
| Pentafluoroethane | $C_2HF_5$ | −48.6 | 66.3 | 36.3 |
| Difluoromethane | $CH_2F_2$ | −51.8 | 78.6 | 58.3 |
| Methyl Fluoride | $CH_3F$ | −78.4 | 42.0 | 56.0 |
| Trifluoroethane | $C_2F_3H_3$ | −47.2 | 72.7 | 37.6 |
| Refrigerant 507A | Mixture | −47.0 | 70.7 | 37.1 |
| Perfluoroethylene | $C_2F_4$ | −76.0 | 33.3 | 39.4 |
| Perfluoropropylene | $C_3F_6$ | −29.6 | 86.2 | 29.0 |
| Difluoroethylene | $CF_2$=$CH_2$ | −84.0 | 30.0 | 44.6 |
| Perfluoroacetonitrile | $C_2F_3N$ | −64.5 | 38.0 | 36.2 |

A dense processing fluid is defined as a dense fluid to which one or more processing agents and optionally one or more cosolvents have been added. The dense processing fluid may be used in processing such as, for example, cleaning and removal of organic fluxes, inorganic salts and other contaminants. In one embodiment, a dense processing fluid is used in a cleaning process to remove one or more contaminants including flux residue. A processing agent is defined as a compound or combination of compounds that promotes physical and/or chemical changes to an article or substrate in contact with the dense processing fluid. It can also enhance the cleaning ability of the dense processing fluid to remove contaminants from a contaminated substrate. Further, the processing agent may solubilize and/or disperse the contaminant within the dense processing fluid. The total concentration of these processing agents in the dense processing fluid typically is about 50 weight percent ("wt. %") or less, or may range from about 0.1 to about 20 wt. %. The dense processing fluid typically remains a single phase after a processing agent is added to a dense fluid. Alternatively, the dense processing fluid may be an emulsion or suspension containing a second suspended or dispersed phase containing the processing agent.

The dense processing fluid comprises one or more dense fluids, optionally a cosolvent, and at least one processing agent. Processing agents may include surfactants, chelating agents, chemical modifiers, and other additives. The processing agent may also be added to the dense processing fluid in an amount ranging from 0.01 to 20 wt. %, or from 1 to 10 wt. %, or from 1 to 5 wt. %. Some examples of representative processing agents include acetylenic alcohols and derivatives thereof (such as derivatized or hydrogenated acetylenic alcohols), acetylenic diols (non-ionic alkoxylated and/or self-emulsifiable acetylenic diol surfactants) and derivatives thereof (such as derivatized or hydrogenated acetylenic diols), acids such as mild phosphoric acid, citric acid, sulfuric acid, hydrofluoroethers (HFE) that are liquid at room temperature such as methyl perfluorobutyl ether or HFE-449S1, HFE-7100, HFE-569SF2, HFE-7200, HFE-7500, HFE-7000 provided by 3M™, alkyl alkanolamines such as diethylethanol amine, alkalis such as potassium hydroxide, quaternary ammonium hydroxides such as tetramethylammonium hydroxide, quaternary ammonium fluoride salts, tertiary amines, diamines and triamines, peroxides (hydrogen peroxide, t-butyl hydroperoxide, 2-hydroperoxy hexafluoropropan-2-ol), haloalkanes (trichloromethane, perfluorobutane, hexafluoropentane), haloalkenes, and combinations thereof.

In one embodiment, the processing agents consist of a family of compounds termed amine-epoxide adducts. These compounds may be formed by end-capping diamines, triamines and/or tetramines such as, but not limited to, ethylene diamine-(EDA), diethyl triamine (DETA), and triethyltriamine (TETA) with alkyl glycidyl ethers such as, but not limited to, n-butyl glycidyl ether (Epodil™741). Some examples of amine-epoxide adduct compounds are disclosed in U.S. Pat. Nos. 6,656,977 and 6,746,623, which are assigned to the assignee of this invention and incorporated herein by reference in their entirety. These adducts are typically straw-colored or colorless liquids that are mildly corrosive with a pH that ranges from 8 to 11. Additional amine epoxide adduct compounds are provided in the following Table II:

TABLE II

| Examples of Amine-Epoxide Adduct Surfactants | |
|---|---|
| DETA/5E741 | Diethylenetriamine capped with 5 molecules of EPODIL ™ 741 (n-butyl-glycidyl ether) |
| DETA/5IBGE | Diethylenetriamine capped with 5 molecules of isobutyl-glycidyl ether |
| DETA/5EHGE | Diethylenetriamine capped with 5 molecules of EPODIL ™ 746 (ethyl-hexyl glycidyl ether) |
| DETA/5E748 | Diethylenetriamine capped with 5 molecules of EPODIL ™ 748 (n dodecyl glycidyl ether) |
| TETA/6BGE | Triethylenetetramine capped with 6 molecules of isobutyl-glycidyl ether |
| EDA/4BGE | Ethylenediamine capped with 4 moles of n-butyl glycidyl ether |
| EDA/4IBGE | Ethylenediamine capped with 4 moles of isobutyl glycidyl ether |
| EDA/4EHGE | Ethylenediamine capped with 4 moles of ethyl hexyl glycidyl ether |
| DAPA/5BGE | Di-aminopropylamine capped with 5 moles of EPODIL ™ 741 (n-butyl glycidyl ether) |
| HMDA/4BGE | Hexamethylenediamine capped with 4 moles of EPODIL ™ 741 (n-butyl glycidyl ether) |
| DAPDEG/4BGE | Di-aminopropylated diethylene glycol capped with 4 moles of EPODIL ™ 741 (n-butyl glycidyl ether) |
| PACM/4BGE | Bis(para-aminocyclohexyl)methane capped with 4 moles of EPODIL ™ 741 (n-butyl glycidyl ether) |

Additional examples of the at least one processing agent include chelating agents such as, but not limited to, beta-diketones such as acetylacetone, acetonyl acetone, trifluoroacetylacetone, thenoyltrifluoroacetone, or hexafluoroacetylacetone, beta-ketoimines, carboxylic acids such as citric acid, malic acid, oxalic acid, or tartaric acid, malic acid and tartaric acid based esters and diesters and derivatives, an oxine such as 8-hydroxyquinoline, a tertiary amine such as 2-acetyl pyridine, a tertiary diamine, a tertiary triamine, a nitrile such as ethylene cyanohydrin, ethylenediamine tetraacetic acid (EDTA) and its derivatives, catechol, choline-containing compounds, trifluoroacetic anhydride, an oxime such as dimethyl glyoxime, dithiocarbamates such as bis (trifluoromethyl)dithiocarbamate, terpyridine, and combinations thereof.

The dense processing fluid may optionally contain a cosolvent. A cosolvent as used herein may enhance the ability of the dense fluid and/or the at least one processing agent to remove contaminants. It may also enhance the solubility of the at least one processing agent, or combination of processing agents, in the dense fluid. In embodiments wherein a cosolvent is added to the dense processing fluid, the cosolvent is preferably at least one cosolvent selected from the group consisting of esters (ethyl acetate, ethyl lactate), ethers (diethyl ether, dipropyl ether), alcohols (methanol, ethanol, isopropanol)) and nitriles (acetonitrile, propionitrile, benzonitrile), hydrated nitriles (ethylene cyanohydrin), glycols (ethylene glycol, propylene glycol), glycol ethers (2-butoxy ethanol, dipropylene glycol methyl ether), monoester glycols (ethylene glycol monoacetate), ketones (acetone, acetophenone) and fluorinated ketones (trifluoroacetophenone), amides (dimethylformamide, dimethylacetamide), carbonates (ethylene carbonate, propylene carbonate), alkane diols (butane diol, propane diol), alkanes such as cyclopentane, heptane, n-hexane, n-butane), dimethyl sulfoxide (DMSO) and combinations thereof. The amount of cosolvent added to the dense fluid may range from 1 to 40 wt. %, or from 1 to 20 wt. %, or from 1 to 10 wt. %.

In formulations wherein a cosolvent is added to the dense processing fluid, the composition of the dense processing fluid comprises from 50 to 99 wt. % of dense fluid, from 1 to 20 wt. % of cosolvent, and from 0.1 to 10 wt. % of at least one processing agent. In one particular embodiment, the dense processing fluid comprises from 65 to 99 wt. % of a dense fluid such as liquid/supercritical $CO_2$, from 1 to 20 wt.

% of a co-solvent such as an amide or DMSO, and from 0.1 to 15 wt. % of at least one processing agent. In another embodiment the dense processing fluid comprises from 0.1 to 99 wt. % of a dense fluid such as liquid/supercritical $CO_2$, from 5 to 90 wt. % of a fluorinated dense fluid (e.g., supercritical hexafluoroethane), from 0.1 to 15 wt. % of at least one processing agent, and from 0 to 20 wt. % of a co-solvent. In yet another embodiment, the dense processing fluid comprises from 0.1 to 95 wt. % of a dense fluid such as liquid/supercritical $CO_2$, from 5 to 99.9 wt. % of a fluorinated dense fluid, from 0 to 40 wt. % of a co-solvent such as an amide or DMSO, and from 0.1 to 40 wt. % of at least one processing agent.

The article or partially treated article is also contacted with a dense rinse fluid. The term "partially treated article" refers to an article that has been contacted with the dense processing fluid. The dense rinse fluid removes any residual contaminants that remain on the partially treated article and/or may have been introduced from contact with the dense processing fluid. The dense rinse fluid may be comprised of any of the dense fluid components disclosed herein and optionally at least one cosolvent such as any of the cosolvents disclosed herein. The article or partially treated article may be contacted with the dense rinse fluid after and/or during at least a portion of the time that the article is contacted with the dense processing fluid. In either embodiment, the dense rinse fluid may be applied to the article at substantially the same process and temperature as the dense processing fluid. Further, the step, of contacting the article or partially treated article with the dense rinse fluid, may be performed in the same processing chamber or a different processing chamber.

Figure 4:
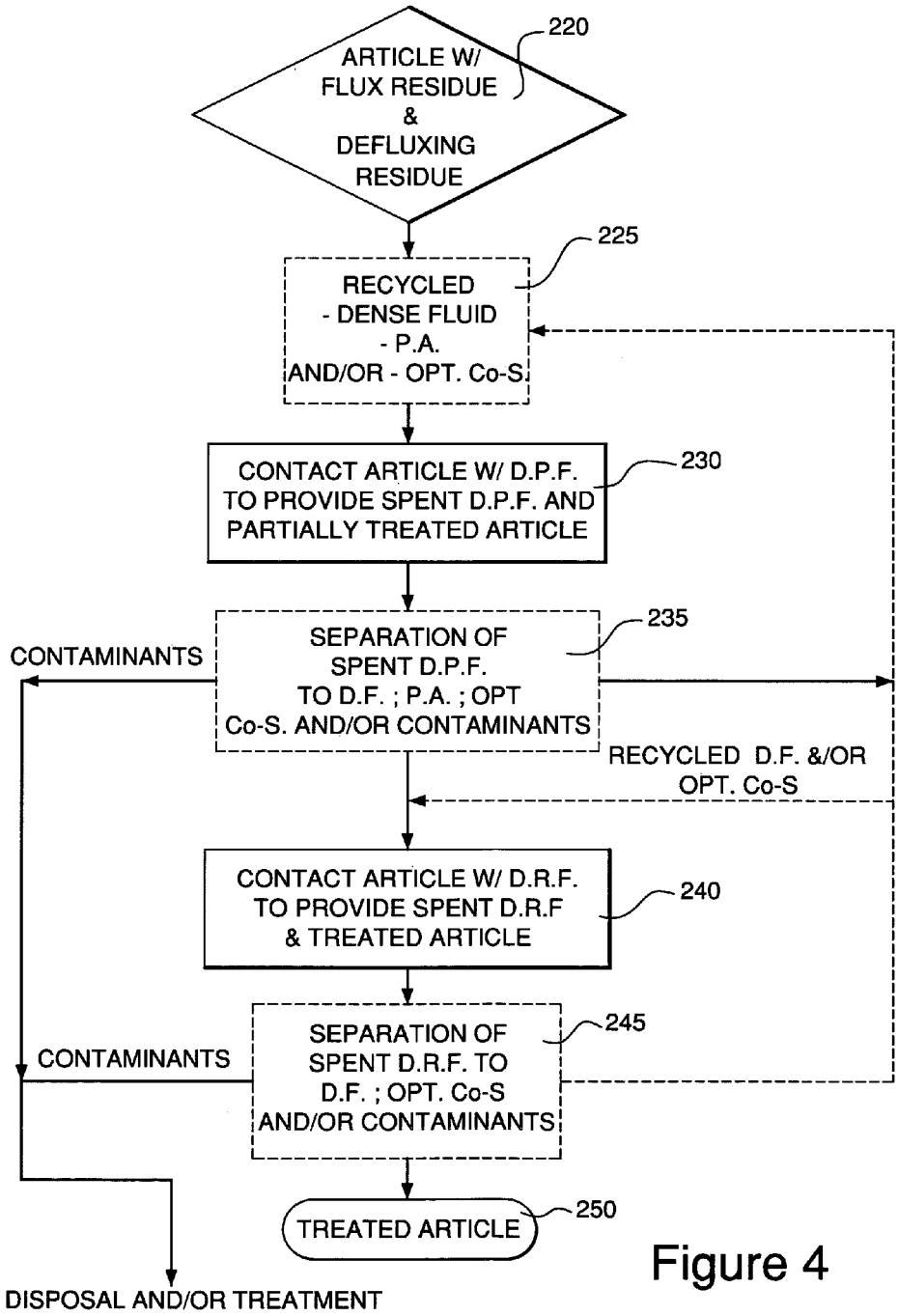
FIG. 4 is a process flow diagram illustrating an embodiment of the invention.

FIG. 4 provides a flow chart of one embodiment of the method of the present invention. Step 220 provides an article that contains contaminants such as organic and/or inorganic flux residues. In step 230, the article is contacted with a dense processing fluid that removes at least a portion of the contaminants and provides a partially treated article and a spent dense processing fluid. In step 240, the partially treated article is contacted with a dense rinse fluid to remove any residual contaminants that remain on the partially treated article and provide a treated article and a spent dense rinse fluid. In step 250, the treated article is ready for further processing.

FIG. 4 also provides an optional separation and recycle loop that is illustrated in dotted lines and shown as steps 225, 235, and 245. In the optional separation and recycle loop, contaminants are separated from the spent dense processing fluid and spent dense rinse fluid to be treated and/or disposed of as shown. In step 225, the recycled dense fluid, processing agent, and/or optional cosolvent, which are separated and brought to the requisite purity level and processing conditions, to be reused in contacting steps 230 and/or 240 (note: the processing agent would not be introduced into the dense rinse fluid). In step 235, the recycled dense fluid and/or optional cosolvent, which is at the requisite purity level and processing conditions, is reused in contacting steps 230 or 240.

In one embodiment for preparing a dense processing fluid, the at least one processing agent and/or cosolvent, may be added to the dense processing fluid, which optionally contains at least one fluorinated dense fluid, either before, during, and/or after transferring the dense fluid from the pressurization vessel to the processing chamber. Alternatively, the at least one processing agent and/or cosolvent, may be added to the subcritical fluid, which optionally contains at least one fluorinated fluid, in the pressurization vessel before, during, and/or after heating the pressurization vessel to transform the subcritical fluid to the dense fluid. The dense rinse fluid may be made in the same manner as the dense processing fluid except that the at least one processing agent is typically omitted.

Figure 5:
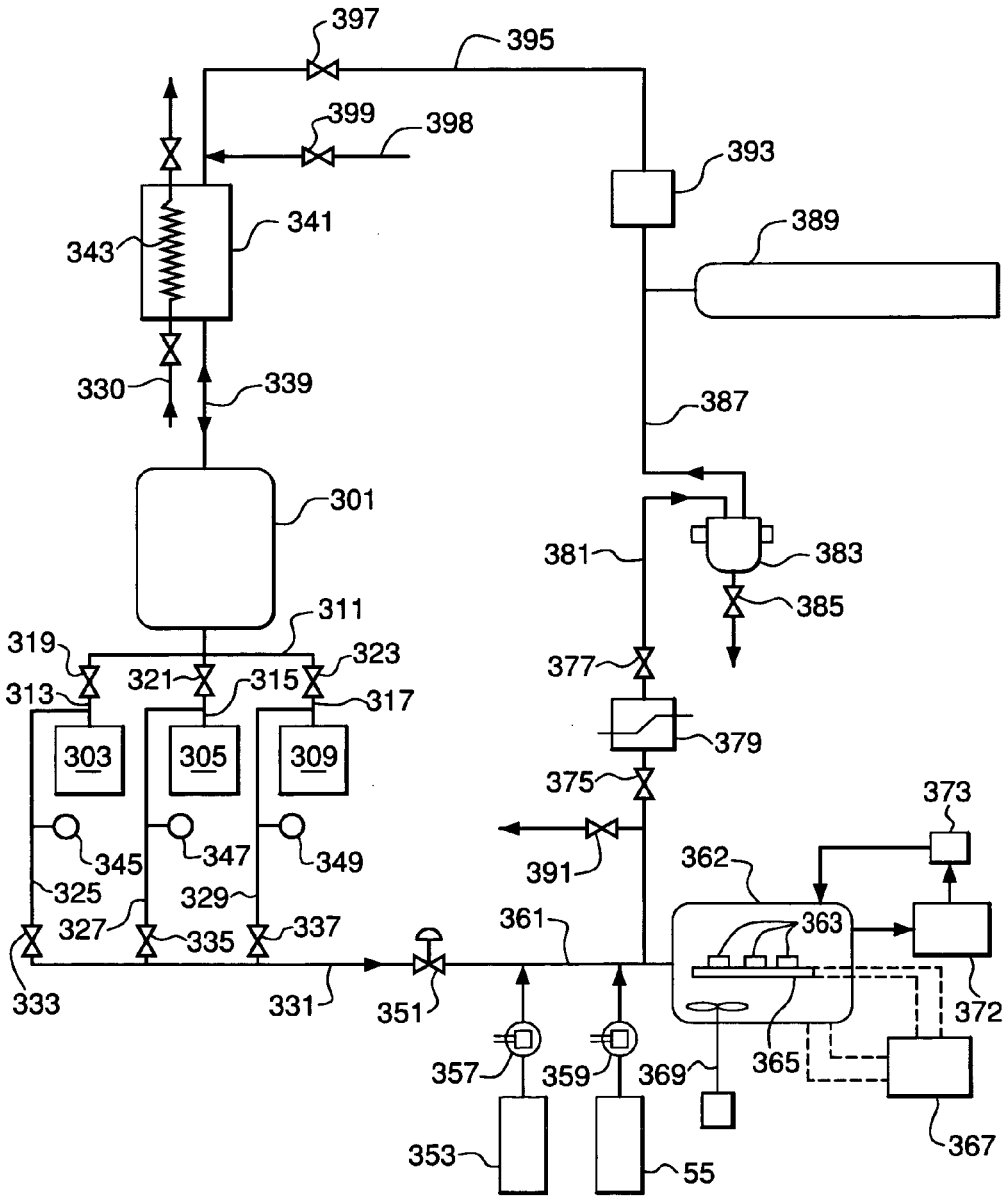
Figure 5 (Prior Art)
FIG. 5 is an exemplary apparatus that may be used with one embodiment of the method described herein.

In one embodiment, the dense processing fluid and the dense rinse fluid may be made using the method and/or apparatus such as that shown in FIG. 5, which illustrates an isochoric (constant volume) carbon dioxide pressurization system to generate a carbon dioxide dense fluid for an ultrasonic electronic component cleaning chamber or processing tool, and includes a carbon dioxide recovery system to recycle carbon dioxide after separation of extracted contaminants. Liquid carbon dioxide and its equilibrium vapor are stored in carbon dioxide supply vessel 301, typically at ambient temperature; at 70° F., for example, the vapor pressure of carbon dioxide is 854 psia. At least one carbon dioxide pressurization vessel is located downstream of the supply vessel 301. In this embodiment, three pressurization vessels 303, 305, and 309 are shown in flow communication with carbon dioxide supply vessel 301 via manifold 311 and lines 313, 315, and 317 respectively. These lines are fitted with valves 319, 321, and 323, respectively, to control flow of carbon dioxide from supply vessel 301 to the pressurization vessels. Fluid supply lines 325, 327, and 329 are connected to manifold 331 via valves 333, 335, and 337 respectively.

Carbon dioxide supply vessel 301 is connected via two-way flow line 339 to carbon dioxide liquefier 341 located above the carbon dioxide supply vessel 301. Heat exchanger 343, which may be a plate and fin or other type of heat exchanger, is used to cool the interior of liquefier 341. A cooling fluid is supplied via line 330 and may be, for example, cooling water at an ambient temperature of 70° F., which will maintain the pressure in carbon dioxide supply vessel 301 at the corresponding carbon dioxide vapor pressure of 854 psia.

Valve 319 may be open while valves 321, 323, and 333 are closed. Valve 335 or 337 may be open to supply dense fluid carbon dioxide to manifold 331 from pressurization vessel 305 or 309, which previously may have been charged with carbon dioxide and pressurized as described below. Liquid carbon dioxide from supply vessel 301 flows downward into pressurization vessel 303 via manifold 311, valve 319, and line 313. As the liquid carbon dioxide enters pressurization vessel 303, which was warmed in a previous cycle, initial liquid flashing will occur. Warm flash vapor returns upward into the carbon dioxide supply vessel 301 via line 313 and manifold 311 as liquid flows downward into pressurization vessel 303. The warm flash vapor flows back into carbon dioxide supply vessel 301 and increases the pressure therein. Excess vapor flows from supply vessel 301 via line 339 to carbon dioxide liquefier 341, wherein the vapor is cooled and condensed to flow downward via line 339 back to supply vessel 301.

After initial cooling and pressurization, liquid carbon dioxide flows from supply vessel 301 into pressurization vessel 303. When the pressurization vessel is charged with liquid carbon dioxide to a desired depth, valve 319 is closed to isolate the vessel. The carbon dioxide isolated in vessel 303 is heated by indirect heat transfer as described above and is pressurized as temperature increases. The pressure is monitored by pressure sensor 345 (pressure sensors 347 and 349 are used similarly for vessels 305 and 309 respectively). As heat is transferred to the carbon dioxide in vessel 303, the temperature and pressure rise, the separate liquid and vapor phases become a single phase, and a dense fluid is formed.

This dense fluid may be heated further to become a supercritical fluid, which may be a fluid at a temperature above its critical temperature and a pressure above its critical pressure. Conversely, the subcritical fluid may be a fluid at a temperature below its critical temperature or a pressure below its critical pressure. The carbon dioxide charged to pressurization vessel 303 prior to heating is a subcritical fluid. This subcritical fluid may be, for example, a saturated vapor, a saturated liquid, or a two-phase fluid having coexisting vapor and liquid phases.

Valve 333 is opened and dense fluid prepared as described above passes through manifold 331 under flow control through metering valve 351. Depending upon whether a dense processing fluid or a dense rinse fluid is being prepared, one or more processing agents from processing agent storage vessel 353 and one or more cosolvents from cosolvent storage vessel 355 may be introduced by pumps 357 and 359 into the dense fluid in line 361 to provide a dense processing fluid or a dense rinse fluid. A dense processing fluid may be made, for example, by introducing a processing agent and optionally a cosolvent via pump 356 and optionally pump 359 into the dense fluid. A dense rinse fluid may be made, for example, by introducing a cosolvent via pump 359 into the dense fluid. In an alternative embodiment, the dense rinse fluid may be the dense fluid itself. The dense processing fluid and/or dense rinse fluid is introduced into sealable processing chamber or process tool 362, which holds one or more articles 363 to be cleaned or processed, and valve 333 is closed. These articles were previously placed on holder 365 in process tool 362 via a sealable entry port (not shown). The temperature in process tool 362 is controlled by means of temperature control system 367. An agitation source such as fluid agitator system 369 mixes the interior of process tool 362 to promote contact of the dense processing fluid and/or dense rinse fluid with articles 363.

In the embodiment shown in FIG. 5, processing chamber or process tool 362 is fitted with an agitation source such as ultrasonic generator 370, which is an ultrasonic transducer array connected to high frequency power supply 371. The ultrasonic transducer may be any commercially available unit such as, for example, an ultrasonic horn from Morgan Electro Ceramics of Southampton, England. Ultrasonic generator 370 typically may be operated in a frequency range of 20 KHz to 2 MHz. As used herein, the term "ultrasonic" refers to any wave or vibration having a frequency above the human audible limit of about 20 KHz. High frequency power supply 371 typically provides power in an ultrasonic power density range of about 20 $W/in^2$ to about 40 $W/in^2$. The interior of process tool 362 typically is exposed to ultrasonic waves for 30 to 120 seconds during the cleaning step. In an alternative embodiment, the dense fluid, dense processing fluid, and/or dense rinse fluid may be prepared by bringing the fluid to its supercritical state using a compressor, pump, or similar means.

The dense processing fluid and the dense rinse fluid can be contacted with the article using a dynamic method, a static method, or combinations thereof. In the dynamic method, a dense processing fluid or a dense rinse fluid is applied to the article by flowing or spraying the fluid, such as for example, by adjusting inlet flow and pressure, to maintain the necessary contact time. Alternatively, the contact steps may be conducted using a static method such as for example, immersing the article within a chamber containing the dense processing fluid or dense rinse fluid or applying the dense processing fluid or the dense rinse fluid to the article and allowing it to contact the dense processing fluid or the dense rinse fluid for a certain period of time.

In some embodiments, the dense processing fluid can be applied to the surface of the article after the introduction of the at least one processing agent and optional cosolvent, by first treating the article with the at least one processing agent and optional cosolvent and then placing the article in contact with the dense fluid to provide the dense processing fluid. Alternatively, the dense processing fluid and the at least one processing agent and optional cosolvent may be introduced into the vessel sequentially, such as, for example, by first introducing the dense fluid and subsequently introducing the processing agent and optional cosolvent. In this case, the dense processing fluid may be formed in multiple steps during the processing of the article. In still further embodiments of the present invention, the processing agent can be deposited upon or comprise the material of a high surface area device such as a cartridge or filter (which may or may not include other additives). A stream of dense fluid then passes through the cartridge or filter thereby forming the dense processing fluid. In still another embodiment of the present invention, the dense processing fluid is prepared during the contacting step. In this connection, at least one processing agent is introduced via a dropper or other means to the surface of the article. The dense fluid medium is then introduced to the surface of the article which mixes with the at least one processing agent on the surface of the article thereby forming the dense processing fluid. Other alternatives include immersing the article in a pressurized, enclosed chamber and then introducing the appropriate quantity of processing agent.

Typically, the contacting step may be performed by placing an article having contaminants within a high-pressure chamber and heating the chamber to the desired temperature. The article may be placed vertically, at an incline, or in a horizontal plane. The dense processing fluid can be prepared prior to its contact with the article surface. For example, a certain quantity of one or more processing agents and optionally a cosolvent can be injected into a continuous stream of the dense fluid medium thereby forming the dense processing fluid. The dense processing fluid can also be introduced into the heated chamber before or after the chamber has been pressurized to the desired operating pressure. During at least a portion of the contacting step with the dense processing fluid, the partially treated article is contacted with a dense rinse fluid.

In one particular embodiment, the desired pressure can be obtained by introducing dense fluid into an enclosed chamber. In this embodiment, additional processing agents (e.g., co-solvents, chelating agents, and the like) may be added at an appropriate time prior to and/or during the contacting step. The processing agent, or a mixture thereof, forms the dense processing fluid after the processing agent and dense fluid have been combined. The dense processing fluid then contacts the article and the contaminant associates with the processing agent and/or mixture thereof, and becomes entrained in the fluid. Depending on the conditions employed in the separation process, varying portions of the contaminant may be removed from the article, ranging from relatively small amounts to nearly all of the contaminant.

During the contacting step, the chamber temperature can range from 10 to 100° C., or from 20 to 70° C., or from 25 to 60° C. The operating pressure can range from 1000 psig to 8000 psig (69 to 552 bar), or from 2000 psig to 6000 psig (138 to 414 bar), or from 2500 to 4500 psig (172 to 310 bar). Optional agitation methods such as ultrasonic energy, mechanical agitation, fluidic jet agitation, pressure pulsing, or any other suitable mixing technique, used alone or in combination, may be used to enhance cleaning efficiency and contaminant removal. In one embodiment, the article is contacted with the dense processing fluid while applying ultrasonic energy during at least a portion of the contacting step. In this embodiment, the ultrasonic energy may be applied using the method and/or apparatus disclosed, for example, in pending U.S. patent application Ser. No. 10/737,458, which was filed on 16 Dec. 2003 which are assigned to the assignee of the present invention and incorporated herein by reference in their entirety.

Any of the elements contained within the dense processing fluid may be recycled for subsequent use in accordance with known methods. For example, in one embodiment, the temperature and pressure of the vessel may be varied to facilitate removal of residual processing agent and/or cosolvent from the article or substrate being cleaned. In an alternative embodiment, one or more components of the dense fluid such as, for example, the perfluorinated and fluorochemical dense fluid, may be separated and recovered using the methods and apparatuses disclosed in U.S. Pat. Nos. 5,730,779; 5,976,222; 6,032,484; and 6,383,257, which are assigned to the assignee of the present invention and incorporated herein by reference in their entirety.

In applying the present invention, articles such as semiconductor substrates may be cleaned or processed individually in order to provide direct process integration with other, single substrate processing modules. Alternatively, multiple articles, or batches, may be cleaned or processed simultaneously in a container or "boat" placed within the cleaning or processing chamber, thereby providing high throughput and reduced cost of operation.

The following Examples illustrate embodiments of the present invention but do not limit the embodiments to any of the specific details described therein.

EXAMPLES

The following examples were performed using an apparatus similar to that depicted in FIG. 5. In the following examples, exemplary articles, or surface mounted LED-on-silicon assembly and a LED/lead frame assemblies, were treated with a dense processing fluid and a dense rinse fluid.

Example 1

Pressurization vessel 303 (see FIG. 5) having a volume of 2.71 liters was filled completely with 4.56 lb of saturated liquid $CO_2$ at 70° F. and 853.5 psia. The density of the initial $CO_2$ charge is 47.6 lb/ft$^3$. The vessel was then sealed. Next the pressurization vessel was heated until the internal pressure reached 5,000 psia. The density of the contained $CO_2$ remained at 47.6 lb/ft$^3$, and the temperature reached 189° F. The contained $CO_2$ is converted to a dense fluid in the supercritical region (see FIG. 2).

An article contaminated with flux residue was loaded into process tool 362 (FIG. 5) having an interior volume of 1 liter. The process tool was evacuated and the vessel walls and wafer were held at 104° F.

Valve 333 connecting pressurization vessel 303 via manifold 331 and line 361 to the process tool 362 was opened; $CO_2$ flows from pressurization vessel 303 into process tool 362, and the wafer is immersed in dense phase $CO_2$. The temperature of pressurization vessel 303 remained at 189° F. The common pressure of the pressurization vessel and process module was 2,500 psia. The temperature of the process tool, 362, remained at 104° F. The dense phase $CO_2$ remains in the supercritical state in both vessels as 1.79 lb of $CO_2$ flows into 1-liter process tool 362 while the remaining 2.77 lb of $CO_2$ remains in 2.71-liter pressurization vessel 303. The density of the $CO_2$ in the cooler process tool reaches 50.6 lb/ft$^3$.

A dense processing fluid was prepared in process tool 362, by pumping 2.5 wt. % of an amine epoxide adduct processing agent (diethyl triamine (DETA) capped with 4.5 moles of n-butyl glycidyl ether) stored in vessel 353, and 5 wt. % of the cosolvent 2-butoxyethanol stored in vessel 355 into the process tool through pumps 357 and 359 respectively. The process tool was then isolated. The articles were exposed to the dense processing fluid at a temperature of approximately 60° C. and a temperature of approximately 3100 psig for approximately 30 minutes. During a portion of the exposing step, the articles were subjected to 20 KHz ultrasonic waves for a period of 60 seconds to provide increased impingement energy. The articles were removed from the processing chamber and inspected by optical microscope. There were no flux residues remaining on the articles. However, a residue of the dense processing fluid was present.

The articles were returned to the processing chamber and then exposed to a dense rinse fluid comprising supercritical $CO_2$ from the pressurization vessel and 10 wt. % of the cosolvent isopropanol whereby the rinse fluid was brought to a supercritical state. The articles were exposed to the dense rinse fluid at a temperature of approximately 60° C. and a pressure of approximately 3100 psig for approximately 30 minutes. During a portion of the exposure step, the articles were subjected to 20 KHz ultrasonic waves for a period of 60 seconds to provide increased impingement energy. The articles were subsequently removed from the process reactor and inspected by an optical microscope. There were no flux residues, processing fluid residues, or any other contaminants remaining on the articles.

Example 2

The process of Example 1 is repeated except that the dense processing fluid contained 2.5 wt. % of the amine epoxide adduct processing agent (diethyl triamine (DETA) capped with 4.5 moles of n-butyl glycidyl ether) as the processing agent, and 5 wt. % isopropanol as the cosolvent.

An inspection performed using optical microscopy showed that the partially treated article had some remaining contaminants after exposure to the dense processing fluid and substantially no remaining contaminants after treatment with the dense rinse fluid.

Example 3

The process of Example 1 is repeated except that the dense processing fluid contained 2.5 wt. % diethylethanolamine as the processing agent.

An inspection performed using optical microscopy showed that the partially treated article had some remaining contaminants after exposure to the dense processing fluid and substantially no remaining contaminants after treatment with the dense rinse fluid.

Example 4

The process of Example 1 is repeated except that the dense processing fluid contained 5.0 wt. % diethylethanolamine as the processing agent, the articles were exposed to the dense processing fluid and the dense rinse fluid at a temperature of approximately 55° C., and were not exposed to ultrasonic waves during contacting with either the dense processing fluid or the dense rinse fluid.

An inspection performed using optical microscopy showed that the partially treated article had some remaining contaminants after exposure to the dense processing fluid and had some minor amounts of remaining contaminants after treatment with the dense rinse fluid. A comparison between the articles of Example 3 and Example 4 illustrates that ultrasonic exposure improves the removal of the fluxing and defluxing residues.

COMPARATIVE EXAMPLE

The process of Example 4 is repeated except that the article was not treated with a dense processing fluid but only treated with the dense rinse fluid that contained 10 wt. % of the cosolvent isopropanol. The articles were exposed at a temperature of approximately 55° C., and were not exposed to ultrasonic waves during contacting with the dense rinse fluid.

An inspection performed using optical microscopy showed that the treated article had almost all the initial contaminants present after exposure to the dense rinse fluid containing just the cosolvent. The level of contamination remaining was approximately 75 to 90% greater than that obtained on inspection after using the process of Example 4 where both a dense processing fluid and a dense rinse fluid are used.

The invention claimed is:

1. A method for removing contaminants from an article, the method comprising:

(a) introducing the article comprising contaminants into a processing chamber;

(b) contacting the article with a first composition to remove at least a portion of the contaminants, wherein the first composition comprises supercritical carbon dioxide, a cosolvent, and at least one amine-epoxide adduct to provide a partially treated article; and (c) contacting the partially treated article with a second composition to remove any remaining contaminants from the article, said second composition consisting of supercritical carbon dioxide and isopropyl alcohol to provide a treated article.

2. The method of claim 1 wherein the at least one amine-epoxide adduct comprises an end-capped polyamine.

3. The method of claim 1 wherein the contaminants comprise organic and inorganic flux residues.

4. The method of claim 2 wherein the end-capped polyamine is selected from the group consisting of diethylenetriamine capped with 5 molecules of n-butyl-glycidyl ether, diethylenetriamine capped with 5 molecules of isobutyl-glycidyl ether, diethylenetriamine capped with 5 molecules of ethyl-hexyl glycidyl ether, diethylenetriamine capped with 5 molecules of n-dodecyl glycidyl ether, triethylenetetramine capped with 6 molecules of isobutyl-glycidyl ether, ethylenediamine capped with 4 moles of n-butyl glycidyl ether, ethylenediamine capped with 4 moles of isobutyl glycidyl ether, ethylenediamine capped with 4 moles of ethyl hexyl glycidyl ether, di-aminopropylamine capped with 5 moles of n-butyl glycidyl ether, hexamethylenediamine capped with 4 moles of n-butyl glycidyl ether, di-aminopropylated diethylene glycol capped with 4 moles of n-butyl glycidyl ether, bis(para-aminocyclohexyl)methane capped with 4 moles of n- butyl glycidyl ether, and mixtures thereof.

5. The method of claim 4 wherein the end-capped polyamine is diethylenetriamine capped with 5 molecules of n-butyl-glycidyl ether.

6. The method of claim 4 wherein the end-capped polyamine is diethylenetriamine capped with 5 molecules of isobutyl-glycidyl ether.

7. The method of claim 4 wherein the end-capped polyamine is diethylenetriamine capped with 5 molecules of ethyl-hexyl glycidyl ether.

8. The method of claim 4 wherein the end-capped polyamine is diethylenetriamine capped with 5 molecules of n-dodecyl glycidyl ether.

* * * * *